US005782932A

United States Patent [19]

van Dijk et al.

[11] Patent Number: 5,782,932

[45] Date of Patent: Jul. 21, 1998

[54] ENZYMATIC COMPOSITION

[75] Inventors: Willem Robert van Dijk, Oud Beyerland; Marja Ouwendijk, Hellevoetsluis, both of Netherlands; Peter John Hall, Bromborough, Great Britain

[73] Assignee: Lever Brothers Company, Division of Conopco, Inc., New York, N.Y.

[21] Appl. No.: 665,748

[22] Filed: Jun. 18, 1996

[30] Foreign Application Priority Data

Jun. 22, 1995 [EP] European Pat. Off. ..... 95304401

[51] Int. Cl.[6] ..... C11D 3/386; C11D 3/37; C11D 3/36

[52] U.S. Cl. ..... 8/137; 510/221; 510/392; 510/420; 510/464; 510/530; 510/340; 510/351; 510/475; 435/187; 435/188

[58] Field of Search ..... 510/321, 372, 510/420, 464, 530, 340, 351, 475; 435/187, 188; 8/187

[56] References Cited

U.S. PATENT DOCUMENTS

| | | | |
|---|---|---|---|
| 2,547,429 | 4/1951 | Alba et al. | 435/204 |
| 4,009,076 | 2/1977 | Green et al. | 435/187 |
| 5,035,900 | 7/1991 | Langley et al. | 424/484 |
| 5,104,584 | 4/1992 | Kong | 510/309 |
| 5,324,445 | 6/1994 | Langley et al. | 510/321 |
| 5,460,817 | 10/1995 | Langley et al. | 424/408 |
| 5,492,646 | 2/1996 | Langley et al. | 510/530 |

FOREIGN PATENT DOCUMENTS

| | | |
|---|---|---|
| 0 346 995 | 12/1989 | European Pat. Off. . |
| 237522 | 7/1986 | German Dem. Rep. . |
| 2354791 | 11/1973 | Germany . |
| 1403257 | 8/1975 | United Kingdom . |
| 94/19529 | 9/1994 | WIPO . |

OTHER PUBLICATIONS

European Search Report.

*Primary Examiner*—K. Fries
*Attorney, Agent, or Firm*—Ronald A. Koatz

[57] ABSTRACT

Enzymatic compositions with improved storage stability of the enzymes contained therein are obtained by including an enzyme stabiliser, preferably by way of a particular process.

4 Claims, No Drawings

ENZYMATIC COMPOSITION

TECHNICAL FIELD

The present invention relates to a enzymatic composition with improved storage stability of the enzymes contained therein.

BACKGROUND & PRIOR ART

It is well known in the art that enzymes can lose their activity with time when included in an aqueous liquid detergent composition, and various proposals have already been made to retard that loss of activity by including in such compositions an enzyme-stabilizing system. Various enzyme stabilisers have been suggested in the art for inclusion in liquid detergent compositions, e.g. polyols (e.g. glycerol), borax (preferably in combination with glycerol), calcium ions, alcohols, low molecular weight carboxylates (formate, acetate, propionate, etc.) and polymers (e.g. polyvinyl-pyrollidone).

We have surprisingly found that inclusion of a certain class of compounds in such aqueous enzymatic liquid detergent compositions retards the loss of enzyme activity.

STATE OF THE INVENTION

We have found that enzyme stability can be improved by using the class of compounds that embraces the group of lignin compounds.

Therefore, the present invention relates to an enzymatic detergent composition with an improved storage stability of enzyme material contained therein, the improved storage stability being obtained by the inclusion in the composition of a lignin compound.

DESCRIPTION OF THE INVENTION

Lignin compounds are mixtures of components and is usually referred to as a polymer which contains, amongst others, phenylpropane units. Lignin compounds can be prepared from the chemical pulping of hard- and softwoods. Lignin compounds have been found to be very effective compounds according to the present invention. There are various lignin compounds which are preferred enzyme stabilisers according to the invention, including Lignosulphonates, Kraft lignins and Oxylignins. All these compounds are considered lignin compounds. These compounds may be prepared from Lignin by various ways, including:

1) treatment with hot (acid) solution of calcium bisulphite which generates Lignosulphonates. The Lignin undergoes a sulphonation and a hydrolysation process under the influence of sulphite.

2) treatment with hot alkaline (pH 13–14) solution of sodium sulphate generates Kraft Lignins, which may subsequently be modified in various ways, e.g. sulphonated, methylated, carboxylated and/or fractionated.

3) reducing the sulphur content of lignosulphonate raw material and optionally applying condensation, cleavage and/or rearrangement, to reduce the number of sulphonic and methoxyl groups and to increase the number of functional phenolic, hydroxyl and carboxylic groups generates Oxylignins.

Further variations to Lignin or any of its derivatives may be made by varying the kind of cation ($Na^+$, $K^+$, $Ca^{2+}$, $Mg^{2+}$, $NH^{4+}$, the degree of sulphonation and/or the average olecular size.

Examples of lignin derivatives that have been found useful are Borresperse NA, Borresperse CA, Kelig FS, Maracarb N-1, Marasperse N-22, Marasperse N-3, Norlig BD, Norlig 415, Ufoxane 2, Ufoxane 3A, Maracell 3A, Vanisperse CB, Ultrazine NA, Ultrazine CA (all ex Borregaard) and lignosulphonates ex Aldrich and ex Sigma as well as ex a number of pharmaceutical companies.

We have found that inclusion of lignin compounds significantly retards the enzyme deactivation, and most surprisingly, lignin compounds are effective as stabiliser at low concentration. Consequently, lignin compounds are included in effective amounts in the composition, in particular in the range of 0.0001 to 10%, preferably 0.001 to 5%, more preferably at least 0.01 and more preferably at most 3% by weight of the composition.

Although the weight ratio between lignin compound and enzyme (as defined as the weight of the active enzyme protein material, which does not include any additives that for example may be present in the enzyme preparations as supplied by the enzyme manufacturers) may be varied widely, as long as the enzyme is effectively stabilised, a weight ratio between 1000:1 and 1:10 has been found to be preferred, more preferably lower than 500:1, most preferably lower than 100:1, in particular lower than 50:1, whereas it is more preferred to have a weight ratio of higher than 1:5, most preferably higher than 1:3, in particular 1:2, more in particular 1:1.

Preferably, the molar ratio between lignin compound and enzyme is from 0.1 to 10,000, more preferably at least 1 and at most 5,000, most preferably at least 2.

It will be understood that presence of other enzyme stabilising systems is not excluded in compositions according to the invention.

Lignin compounds have been described in the art for several applications.

GB-A-1,403,257 discloses use of lignin in enzyme preparations which may be included in solid compositions. The enzyme preparations are purified by precipitating protease or a-amylase with a tanning agent or lignin, whereafter the solid enzyme preparation is filtered off.

DE 23 54 791 discloses the use of lignosulfonates as coating material for enzyme granules for use in powdered compositions.

DD 237,522 discloses a process for cleaning an enzyme concentrated containing protease and/or by α-amylase by precipitating undesired polution.

Use of lignin preparations to inhibit enzyme activity at low pH in the human stomach is discussed in ZA 6803394 and in EUR J Pharmacol 41 (2) 1977 p 235–238; coden: EJPHAZ ISSN: 0014–2999 [EM].

WO 94/19529 discloses a process for providing localized variation in the colour density of fabrics by using a cellulase enzyme and a polymeric agent.

The invention further relates to a liquid enzymatic composition comprising from one or more enzymes and one or more enzyme stabilisers, characterised in that the stabiliser comprises a water-soluble, cross-linked polymer containing sulphonate-groups, preferably containing benzene units and more preferably containing phenylpropane units.

The enzymatic composition of the present invention contains as essential ingredients one or more enzymes, preferably at least including a proteolytic enzyme.

The enzymes that may be used in the present invention are proteases, amylases, lipases, cellulases and mixtures of one or more of these enzymes. Proteases are preferred enzymes for use in the present invention, as we have seen the best results with protease stabilisation.

Depending on the type of composition (i.e. diluted or concentrated enzyme composition) and, of course, whether the enzyme type is present at all, the enzymes preferably provide a proteolytic activity between 0.1 and 50 GU/mg, a lipolic activity between 0.005–100 LU/mg and an amylotic activity between $10^3$ to $10^7$ MU/kg, wherein GU, LU and MU units are well known in the art and have e.g. been defined in lines 8–14 of column 3 and lines 8–12 and 21–24 of column 4 of U.S. Pat. No. 5,112,518.

Depending on the composition type, the level of active enzyme protein will be higher (up to 10%, preferably up to 5% by weight for concentrated enzyme preparations, e.g. as supplied by enzyme manufacuturers) or lower (up to 3%, preferably up to 1.0%, although levels up to 0.5% or up to 0.1% or even as low as up to 0.05% are also suitable for more dilute systems, e.g. commercial liquid detergent compositions in which the concentrated enzyme preparations are used during production). The active enzyme protein level may be as low as 0.00010%, preferably at least 0.0% by weight of the composition. Again in more concentrated enzyme preparations, the lower level will be higher, e.g. at least 0.5% by weight.

We have further found that combinations of enzymes (especially when they include proteases) may be stabilised by using the invention. As compared to the composition without the stabiliser, they show strongly improved stability overall.

Preferably, detergent-active component is included and may be either soap, anionic, nonionic, cationic or zwitterionic detergents and mixtures of one or more of these detergent-active components. Preferably, nonionic detergent is used, either as such or in admixture with a anionic detergent-active component. Usually, the total amount of detergent-active component(s) ranges from 5% to 70%, preferably from 10 to 40% by weight of the total composition.

Preferably, compositions according to the invention have an ionic strength and contain electrolyte material. Preferably, electrolyte material is selected from the group consisting of phosphate, phosphonate, borate, carboxylates (e.g. citrate, NTA and succinate such as C12 alk(en) ylsuccinate), carbonate, sulphate and chloride. Preferably, the electrolyte material is present at a level of at least 1%, more preferably at least 2%, most preferably at least 3%, in particular at least 5%, e.g. at least 10% by weight of the composition. Suitable levels are at least 15% by weight of the composition. Preferably, the composition comprises less than 25% by weight of electrolyte material.

The composition may furthermore contain other optional ingredients such as perfumes, colouring materials, soil-suspending agents, other enzyme-stabilising agents, builder, bleaching agents, bleach precursors, hydrotropes, solvents, suspending agents, suds suppressors, polymers (e.g. for oily soil or particulate soil removal or as anti-due transfer agent), fluorescers, etc.

The enzymatic composition may be in the powdered form, but is preferably in the liquid form. The composition may be an isotropic or a structured liquid. Structured liquids (i.e. containing lamellar droplets of surfactant material) are the most preferred liquids.

Preferably, liquids according to the present invention are prepared by mixing an enzyme preparation and one or more enzyme stabilisers, wherein the enzyme stabiliser comprises lignin compounds.

Preferably, the pH of the liquid formulations according to the present invention is higher than 4, more preferably higher than 5, most preferably higher than 5.5 and preferably lower than 11, more preferably lower than 10, most preferably 9.0 or lower.

To improve the enzyme stability even further, the lignin compound is preferably brought in contact with the enzyme in a form in which the lignin is at least partially dissolved. This may be done in various ways, including chosing a certain order of addition that results in this effect. A premix of enzyme and lignin can be made which is then mixed with the other ingredients or lignin is added in the form of a solution, preferably in the form of a solution in a solvent, e.g. selected from alcohols and/or water. Examples of suitable solvent systems are water and a 25% propyleneglycol solution.

The invention will now be illustrated by way the following non-limiting examples.

EXAMPLES

Example 1

The following formulation 1 was prepared:

| Ingredients | % by weight |
|---|---|
| LAS (Na salt) | 23 |
| Nonionic* | 10 |
| Citrate (Na salt) | 17 |
| Polymer material** | 1.0 |
| Savinase 16.0L (ex NOVO) | 0.38% |
| Minors | 0.25 |
| Water | to 100% |

*Nonionic is an ethoxylated alcohol.
**(as 100%) Polymer A11 as desecrbed in EP 346,995. Polymer A11 is a deflocculating polymer.

The protease stability at 37° C. was measured in the presence of various levels of sodium ligno-sulphonate. The following results were obtained after 10 days.

| % by weight Ultrazine NA ® *** | % residual activity |
|---|---|
| 0 | 25 |
| 0.005 | 52 |
| 0.010 | 63 |
| 0.015 | 68 |
| 0.025 | 80 |
| 0.050 | 89 |
| 0.100 | 82 |

*** a sodium lignosulphonate, ex Borreqaard, added on top of formulation in powdered form.

It can be clearly seen that the lignin compound has good enzyme stabilising properties, even at very low concentrations.

Example 2

Lipolase® (100L, ex NOVO) was added to formulation 1 of Example 1 at a level of 0.2% and the lipase activity was determined after 10 days storage at 37° C.

| % by weight Ultrazine NA ® *** | % residual activity |
|---|---|
| — | 3 |
| 0.005 | 3 |
| 0.010 | 5 |
| 0.015 | 5 |
| 0.025 | 38 |
| 0.050 | 50 |
| 0.100 | 80# |

*** a sodium lignosulphonate, ex Borregaard, added on top of formulation in powdered form.

It can be clearly seen that the lignin compound has good lipolase stabilising properties in the presence of protease.

Example 3

The following liquid formulation 2 was prepared by neutralising a premix of the detergent active material, mixing in the builder material and the minors. Enzyme material was added as last ingredient. Stabiliser (if any) was post-dosed.

| Ingredients | % by weight |
|---|---|
| Anionic | 16.5 |
| Nonionic | 4.5 |
| Oleic acid | 4.5 |
| Citric acid | 8.2 |
| Zeolite | 15.0 |
| KOH | 10.3 |
| Polymer* | 1.0 |
| Protease** | 0.38 |
| Lipase*** | 0.2 |
| Minors | 0.9 |
| Water | to 100 |
| pH liquid 8.5 | |

*Polymer A11 of EP 346995
**Protease is Savinase 16.0L (ex Novo)
***Lipase is Lipolase 100L (ex Novo)

The enzymatic activites in the liquid after 28 days of storage at 37° C. was as follows when Ultrazine NA was added in the form of a solution in 25% propyleneglycol solution:

| % by Ultrazine NA | % Residual protease act. (no lipase) | % Residual protease act. (with lipase) | % Residual lipase act. (with prot.) |
|---|---|---|---|
| 0 | 30 | 24 | 0 |
| 0.025 | 58 | 63 | 22 |
| 0.05 | 75 | 73 | 43 |
| 0.1 | 79 | 80 | 53 |

The enzymatic activites in the liquid after 28 days of storage at 37° C. was as follows when Ultrazine NA was added in solid form:

| % by Ultrazine NA | % Residual protease act (no lipase) | % Residual prot. act (with lipase) | % Residual lipase act. (with prot.) |
|---|---|---|---|
| 0 | 30 | 24 | 0 |
| 0.025 | 36 | 35 | 7 |

-continued

| % by Ultrazine NA | % Residual protease act (no lipase) | % Residual prot. act (with lipase) | % Residual lipase act. (with prot.) |
|---|---|---|---|
| 0.05 | 48 | 49 | 15 |
| 0.1 | 52 | 58 | 28 |

It can be clearly seen that the lignin compound has good protease and lipase stabilising properties, even at very low concentrations.

Addition of the Ultrazine NA in soluble form results in even better enzyme stability.

Example 4

The formulation of Example 1 was prepared. Stabiliser (if any) was post dosed. The enzymatic activites in the liquid after 14 days of storage at 37° C. was as follows when Ultrazine NA was added in a solution in 25% propyleneglycol in water:

| % by weight Ultrazine NA | % Residual protease activity (with lipase) | % Residual lipase activity (with protease |
|---|---|---|
| 0 | 13 | 4 |
| 0.025 | 57 | 25 |
| 0.05 | 67 | 53 |
| 0.1 | 70 | 63 |

The enzymatic activites in the liquid after 14 days of storage at 37° C. was as follows when ultrazine NA was added in solid form:

| % by weight Ultrazine NA | % Residual protease activity (with lipase) | % Residual lipase activity (with protease |
|---|---|---|
| 0 | 13 | 4 |
| 0.025 | 50 | 24 |
| 0.05 | 62 | 53 |
| 0.1 | 66 | 60 |

It can be clearly seen that the lignin compound has good protease and lipolase stabilising properties, even at very low concentrations. Addition of the Ultrazine NA in soluble form results in even better enzyme stability.

Example 5

The formulation of Example 3 was prepared. Various lignin compounds were added at a level of 0.1% by weight and the following stabilisation results were obtained, expressed as residual activity (in % of original activity) relative to the blanc (i.e. delta value).

| | Delta % residual act. | |
|---|---|---|
| Lignin compound | Lipase | Protease |
| Marasperse N-22 (ex Borregaard) | 37 | 47 |
| Marasperse N-3 (ex Borregaard) | 29 | 29 |
| Marasperse AG (ex Borregaard) | 26 | 29 |
| Maracell (ex Borregaard) | 46 | 50 |
| Maracarb (ex Borregaard) | 45 | 40 |
| Norlig 612 (ex Borregaard) | 34 | 43 |
| Norlig (ex Borregaard) | 38 | 45 |

-continued

| Lignin compound | Delta % residual act. Lipase | Protease |
|---|---|---|
| Ultrazine NA (ex Borregaard) | 48 | 57 |
| Borresperse CA (ex Borregaard) | 36 | 44 |
| Borresperse NA | 39 | 38 |
| Ultrazine CA (ex Borregaard) | 44 | 50 |
| Ufoxane 2 (ex Borregaard) | 30 | 29 |
| Ufoxane 3A (ex Borregaard) | 38 | 35 |
| Na-lignosulphonate (ex Aldrich) | 39 | 44 |

All lignins show lipase and protease stabilising effects.

We claim:

1. A detergent composition comprising the following:

(A) 10% to 40% of a surfactant mixture comprising a linear alkyl benzene sulfonate and an ethoxylated alcohol;

(B) 0.005% to 0.100% of sodium lignosulphonate;

(C) 15% to 25% of an electrolyte material selected from the group consisting of phosphate, phosphonate, citrate, and borate;

(D) a protease enzyme in an amount which produces 0.1 to 50 GU/mg of proteolytic liter;

(E) about 1% of a deflocculating polymer;

(f) and the balance is water.

2. A detergent composition according to claim 1 wherein said electrolyte is a mixture selected from the group consisting of phosphonate, citrate, borate, and phosphate.

3. A detergent composition comprising the following:

(A) 10% to 40% of a surfactant mixture comprising a linear alkyl benzene sulfonate and an ethoxylated alcohol;

(B) 0.025% to 0.100% of sodium lignosulphonate;

(C) 15% to 25% of an electrolyte material selected from the group consisting of phosphonate, citrate, borate, and phosphate;

(D) a lipase enzyme in an amount which produces 0.005 to 100 LU/mg of lipolytic activity;

(E) about 1% of a deflocculating polymer;

(F) and the balance is water.

4. A detergent composition according to claim 3 wherein said electrolyte is a mixture selected from the group phosphonate, citrate, borate, and phosphate.

* * * * *